United States Patent [19]

Terry

[11] 4,069,868

[45] * Jan. 24, 1978

[54] METHODS OF FLUIDIZED PRODUCTION OF COAL IN SITU

[75] Inventor: Ruel C. Terry, Denver, Colo.

[73] Assignee: In Situ Technology, Inc., Denver, Colo.

[ * ] Notice: The portion of the term of this patent subsequent to Apr. 6, 1993, has been disclaimed.

[21] Appl. No.: 595,335

[22] Filed: July 14, 1975

[51] Int. Cl.[2] ..... E21B 43/24

[52] U.S. Cl. ..... 166/258; 166/267; 166/302

[58] Field of Search ..... 166/256, 258, 259, 272, 166/302, 267; 249/3, 4, 5, 6

[56] References Cited

U.S. PATENT DOCUMENTS

| | | | |
|---|---|---|---|
| 2,584,605 | 2/1952 | Merriam et al. | 166/258 X |
| 3,599,714 | 8/1971 | Messman et al. | 166/258 |
| 3,809,159 | 5/1974 | Young et al. | 166/258 |
| 3,924,680 | 12/1975 | Terry | 166/258 |
| 3,948,320 | 4/1976 | Terry | 166/272 |

*Primary Examiner*—Stephen J. Novosad
*Assistant Examiner*—George A. Suchfield

[57] ABSTRACT

A method of producing combustible gases, synthetic crude oils, coal chemicals and heat from coal in situ utilizes the combined teachings of in situ gasification, liquefaction and pyrolysis in separated coal blocks.

8 Claims, 7 Drawing Figures

METHODS OF FLUIDIZED PRODUCTION OF COAL IN SITU

BACKGROUND OF THE INVENTION

The present invention relates generally to the production of coal in situ into combustible gases, synthetic crude oils, coal chemicals and an underground system for production of industrial steam.

The civilized world is highly dependent on sources of energy for the necessities and amenities of life. In early times wood provided the energy for heat and light. With a growing world population and with forests denuded around the populated areas, coal gained favor as a source of heat and light, and later provided a source of energy for mechanized transportation and a host of other mechanical devices. Coal, of course, is more compact than wood and, therefore, contains more energy per unit weight or unit volume, and from that point of view is more desirable than wood.

As sources of energy, both wood and coal involve a series of batch operations. For wood, the tree is found and felled, useless parts such as twigs and leaves separated and disposed of, then lengths are cut to appropriate sizes, loaded on conveyances, carted to the point of use, off-loaded, stacked, picked up a few pieces at a time and cast into the fire, ashes are then removed and disposed of, and so on. Similarly, coal is found, grubbed out, obvious extraneous matter separated and disposed of, then broken down or crushed to desired sizes, loaded, transported to the point of use, off-loaded, piled, picked up and cast into the fire, then ashes and clinkers are removed and disposed of, and so on.

The discovery of commercial quantities of crude oil and natural gas led to massive displacements of wood and coal as sources of energy. Petroleum, of course, compared to wood or coal contains more energy per unit weight. Petroleum is fluid, clinker free, and is or can be made ash free. Further, petroleum can serve as a source of energy in a series of continuous operations from the oil field to the end use. Batch operations, by nature costly, are essentially eliminated and messy cleanup as an aftermath of use is also eliminated. For decades petroleum discoveries were so prolific that supplies substantially exceeded demands with resultant abnormally low prices compared to other commodities in commerce.

Like the denuded forest of old, times today have changed. The easy to find oil fields of the world have been found. New discoveries of oil fields in recent years have tended to be located vast distances from population centers. The laws of supply and demand have been supplanted with international politics in the setting of market prices. Thus coal has been reinstated as a major source of future energy supplies.

Coal has retained its advantages of being more favorably located in relation to the population centers of the world. Worldwide reserves of coal dwarf the known worldwide reserves of petroleum. For almost 100 years petroleum has been available in copious quantities at abnormally low prices. As a consequence, worldwide technical development was focused on petroleum to the virtual exclusion of technical development in coal. A look at the coal industry today reveals only token improvements over the old batch operations of grub, sort, crush, load, cart, off-load pile, pick up, stoke and clean up. While it is true that individual operations have become highly mechanized with mammoth devices, the elements of batch operations remain. Batch operations, no matter what size, have great difficulty in competing with continuous operations of similar size.

The state of the art in the coal industry requires a lot of catching up to match the state of the art in the petroleum industry. First, coal should be brought to the surface as a fluid. A review of the prior art in coal shows that most of the work to fluidize coal has been performed after the coal was brought to the surface as a solid. This arrangement, of course, retains the batch operations of grub, sort, crush, load, cart, off-load, pile and pick up. After these batch operations have been performed and coal is transported to suitable above ground pressure vessels, it is well known in the art how to fluidize coal into combustible gases, into coal chemicals, and into synthetic crude oil. Unfortunately these operations also tend to be batch or semi-batch types.

Since the preponderance of the prior art of the above ground fluidization of coal begins after the coal has been mined by conventional methods, the feedstock is delivered with its two principal impurities — moisture and ash contents — intact. Moisture may be substantially removed in a separate batch operation, but the ash content is normally introduced into the pressure vessel for removal at a later step in the fluidizing process. It should be obvious that a vast improvement would be made if the moisture content and the ash content were separated before the coal is brought to the surface.

Some prior art has dealt with fluidizing coal in situ. The preponderance of this work has been involved with in situ gasification of coal with the objective of producing combustible gases. Large scale operations were undertaken in Russia with lesser projects of shorter duration undertaken in the United States, England, Morrocco and other localities All have been plagued with problems of underground burning consuming the combustible gases before they could be delivered to the surface. All have produced low BTU gases (in the range of 85 to 300 BTU per standard cubic foot) compared to natural gas of petroleum origin containing approximately 1000 BTU per standard cubic foot. These low BTU gases, while not suited to long distance pipelining, are quite satisfactory for nearby use if the BTU content can be stabilized at a reasonably constant level.

All in situ gasification projects heretofore seem to have overlooked a significant fact in their quest to generate combustible gases. The purpose of combustible gases as fuel is to generate heat. It, therefore, follows that it may not make too much difference whether the gas is burned below ground or above ground as long as the heat is captured to perform the useful work intended. If the heat is captured underground and brought to the surface, then the bothersome problem of preventing unplanned burning of combustible gases underground is eliminated. Methods of capturing heat underground will be apparent later in this disclosure.

A search of the prior art has revealed a meager amount of meaningful work in attempting to subject coal to pyrolysis in situ. Methods of pyrolizing coal in situ will be apparent later in this disclosure.

There has been a limited amount of work in the art of in situ liquefaction of coal. Methods have been described in U.S. Pat. No. 2,595,979 of Pevere et al, beginning with coal at ambient temperatures. No projects are known to applicant where coal has been liquefied in situ, using coal that is already hot. Methods of liquefying coal in situ, using hot coal as the raw material, will become more apparent later.

In order to understand the problems of producing coal in situ, it is helpful to understand some of the characteristics of coal. Coal had its origin in ancient geological times when large areas of the earth were relatively flat and swampy, and plant life grew in profusion. Over and over plants sprouted, grew, matured, died, fell in the water, then were replaced by many generations of other plants which repeated the cycle. Severe rotting occurred to dead plant parts protruding above the water, while submerged plant parts were substantially preserved. The accumulated plant debris, often many feet thick, contained a variety of components including roots, trunks, bark, limbs, leaves, moss, reeds, grasses, and mineral matter deposited by dust laden winds. Later in geological time the areas were inundated and deposits of mud, sands and clays sank to the bottom. These sediments ultimately formed the shales, sandstones, and limestones that overlie coal deposits today. The sediments, of course, provided the weight to compact the plant debris and thus began the evolution into coal. With the variety in the plant debris it is easy to understand why today some coal is hard, some soft, some difficult to crush, some easy to crush, some highly permeable, some with hardly any permeability, and so on. With buckling of the earth's crust, such as occurred when mountains were formed or during earthquakes, it is also easy to understand how some coal deposits underground contain an extensive pattern of fractures and cracks that permit the passage of fluids.

For purposes of illustration, subbituminous coals as found in the western part of the United States are used in describing the processes herein, although coals of higher or lower rank are also applicable. These coals contain carbon, hydrogen, moisture and mineral matter. The carbon and hydrogen are combined into hydrocarbons that are similar to those found in crude petroleum, although the total hydrogen content in coal is only about half that of similar units of crude petroleum. It is this hydrogen deficiency in coal compared to petroleum, that prevents coal from being a ready substitute for petroleum. A proper planning of processes and projects, as will be described hereinafter, can produce products from coal that are readily interchangeable with products from crude petroleum.

The most prevalent use of hydrocarbons is as a fuel, whether the source be from petroleum or coal. In the combination process hydrogen ($H_2$) is burned with oxygen ($O_2$) to form water vapor ($H_2O$), carbon is burned with oxygen to form carbon dioxide ($CO_2$), and any sulfur present forms sulfur dioxide ($SO_2$). These are the reactions when there is sufficient oxygen present to yield an oxidizing environment. With a shortage of oxygen and thus a reducing environment, substantially all of the carbon burns to carbon monoxide (CO) and sulfur combines to form hydrogen sulfide ($H_2S$). In the combustion zone it is possible to have both oxidizing and reducing environments which will result in products of combustion containing water vapor, carbon dioxide, carbon monoxide, sulfur dioxide, hydrogen sulfide, free hydrogen, free oxygen and free carbon. As a practical matter in commercial operations it is desirable to control combustion either to a predominantly oxidizing or to a predominantly reducing environment.

In an oxidizing environment, the water vapor and carbon dioxide have contributed the maximum to the generation of heat from the fire. The sulfur dioxide can be further oxidized with a catalyst into sulfur trioxide ($SO_3$) which combines with water vapor to form a sulfuric acid mist ($H_2SO_4$). Thus the oxidizing environment yields the most heat but in the presence of sulfur yields objectionable sulfur dioxide, sulfur trioxide or sulfuric acid, all of which are troublesome in the exit gases.

In the reducing environment, the carbon monoxide that is produced can be further oxidized and thus has a useful calorific content (approximately 315 BTU/cu ft) as a pipeline gas. The presence of sulfur yields hydrogen sulfide, which is relatively simple to separate from the exit gases. The reducing environment generates substantial quantities of heat, but much less than the oxidizing environment. In the predominantly reducing environment carbon dioxide ($CO_2$) reacts with incandescent carbon to form additional carbon monoxide (CO). As is well known in the art practiced above ground, incandescent carbon in the presence of water (or steam) reacts to form producer gas as follows:

$$H_2O + C = H_2 + CO$$

This reaction absorbs considerable heat, but at the same time releases two valuable gases, hydrogen and carbon monoxide. Both of these gases, when properly redirected as described herein, server as feedstocks to upgrade nearby coal in situ. The hydrogen generated underground is particularly useful in remedying the hydrogen deficiency of a portion of the coal in situ and also can be used as a feedstock for commercial facilities above ground.

A survey of the coal research and development shows that the preponderance of effort is directed to work above ground in gasification and liquefaction. All projects are plagued with a common problem; the hydrogen deficiency of coal. To understand the magnitude of the problem, consider the manufacture of fuel gases from coal. As previously mentioned, it is well known in the art how to derive producer gas (sometimes called blue water gas) by reacting steam with incandescent carbon to form hydrogen and carbon monoxide. Both hydrogen and carbon monoxide are good fuel gases, each containing slightly over 300 BTU per cubic foot. Both fall woefully short in heat values; however, when compared to natural gas of petroleum origin which contains approximately 1000 BTU per cubic foot. It is well known in the art how to upgrade producer gas into gases with higher BTU content, but if upgrading is expected to be compatible with natural gas (principally methane, $CH_4$), makeup hydrogen is required in substantial quantities. For a typical coal to be upgraded into methane, almost three times as much hydrogen is required as is contained in the original coal. For liquefaction of coal, makeup hydrogen is also required because synthetic crude oil from coal contains approximately twice as much hydrogen as the original coal contained. Coal chemicals, however, can be extracted from raw coal without makeup hydrogen, simply by subjecting the coal to heat in the absence of air and capturing expelled gases and oozing tars.

Most underground coal deposits contain a certain amount of trapped gas in the pore space and in channels of permeability. The most common entrained gas is methane (sometimes called fire damp) which often is found in quantities of 50 to 300 standard cubic feet per ton of coal in place. This gas is a fire hazard and a health hazard to underground workmen. Since the processes described herein require no manpower underground, entrained methane is readily captured for commercial use.

Referring again to producer gas generated from coal, either above ground or in situ, it is easy to understand the commercial desirability of upgrading. First is the problem of transportation. Cross country pipelines experience about the same amount of costs whether the gas transported be producer gas at 320 BTU per cubic foot or natural gas at 1000 BTU per cubic foot. It, therefore, follows that a million BTU's of producer gas at the destination will cost approximately three times as much in transportation charges as the same amount of BTU's delivered as natural gas. Second, while producer gas is an excellent fuel, it is not compatible with natural gas at the burner tip. Heating devices must be designed for one or the other, and substantial mechanical modifications normally must be made to convert from one gas to another.

With the worldwide reawakening to the importance of coal as a source of energy, both as a direct source of fuel and as a source of feedstocks for synthetic fuels, considerable outcry has been advanced regarding the environmental impact of coal production. In the United States, for example, powerful lobbying groups have joined forces to stop or severely restrict some of the mining methods practiced in the past. Gutting of the countryside, no doubt, will be a practice of the past, both in the United States and elsewhere. Coal production operations of the future must be designed to minimize damage to the environment as well as provide for restoration to proper aesthetic values upon termination of operations. Gutting of the countryside, in itself a costly operation, is overshadowed in terms of cost by the effort required in restoration. Restoration, no matter how well planned, leads to virtually endless differences of opinions as to the effectiveness of the job.

A minimum environmental impact occurs when coal is consumed in situ. Surface disturbance is kept to a minimum by drilling wells into the coal deposit. Then the coal can be subjected to in situ gasification, pyrolysis and liquefaction. By proper planning, subsidence can be controlled over a wide area, resulting in minor lowering of the landscape, the surface of which remains virtually intact.

INTRODUCTION

A major coal deposit underground can be consumed in situ resulting in the production of hydrogen, carbon monoxide, methane, steam, electricity, synthetic crude oil, sulfur, fertilizers, solvents, coal chemicals and a host of other useful products. Preferably the coal deposit is located several hundred feed underground, is composed of several strata of coal overlying each other with each stratum separated by a thin stratum of shale, and with one or more strata of coal being an aquifer. In this arrangement the overburden serves as a seal and source of pressure, so that each coal stratum may be pressurized with injected fluids without fear of blow-outs to the surface. The coal strata that are aquifers serve as a source of water for the processes described herein. Since in situ combustion is required, the water bearing coal stratum also serves as a deterrent to runaway burns underground.

Recognizing the many valuable products that may be derived from coal, those skilled in the art will be able to visualize product sequences not specifically described herein, but within the spirit and scope of those processes described for illustrative purposes. Further, no particular novelty is claimed for such well known processes as combining hydrogen with carbon monoxide to yield methane, converting hydrogen sulfide to elemental sulfur, distillation of coal derived from volatiles into various coal chemicals, and others. Novelty is claimed, however, in various series of methods and arrangements to accomplish the overall results described herein.

OBJECTS OF THE INVENTION

It is an object of the present invention to provide a new and improved method and apparatus for consuming coal in situ in order to derive a series of commercial products therefrom.

It is another object of the present invention to eliminate substantially the numerous batch type opearations inherent in prior art applications of coal production and coal derivatives.

It is another object of the present invention to provide a method and apparatus for capturing sensible heat from underground burning of coal for further useful work above ground.

It is another object of the present invention to provide a new and improved method and apparatus for separating the useful components of the products of combustion and the products of chemical reaction underground of coal, and to use these components in commercial application.

It is still another object of the present invention to provide a new and improved method and arrangements of apparatus resulting in the integrated use of raw materials generated from coal in situ to create a host of finished products above ground.

Other objects of the invention will be apparent to those skilled in the art as the description proceeds.

DESCRIPTION OF THE PREFERRED EMBODIMENT

The first steps of this invention involve reconnaissance of a coal deposit itself. Evaluation wells are drilled from the surface of the ground through the overburden and to the bottom of the lower coal stratum. It is desirable to take cores of the overburden above the uppermost coal stratum to ascertain the competentness of the rock. It is desirable to take oriented cores in each of the coal strata to determine the pattern of permeability. It is also desirable to test each coal stratum to determine the water bearing capabilities. Examination of the oriented cores in the first few evaluation wells will assist in determining the locations of subsequent evaluation wells. It is desirable to drill the evaluation wells in such a way that they may be used later as production, injection, or service wells. It is important that all wells drilled into the coal section be completed in such a way as to maintain a hermetic seal from the surface through the coal strata.

From the data derived from the evaluation wells, it is possible to plan the overall project. Sequence of production cycles can be established, zones of production can be identified, individual plants in the complex of plants above ground can be sized for compatibility with the overall project, utilities and service roads can be planned, and the wells can be equipped for the first series of production sequences.

The phases of production identified hereinafter are used for purposes of facilitating an understanding of the invention; however, it is to be recognized that the same production phases could be performed simultaneously in several nearby mining areas in order to yield desired production volumes to feed optimum sized plants at the surface. The phases of production described in detail hereinafter can be summarized as including:

Phase 1, gasification in a reducing environment;
Phase 2, gasification in an oxidizing environment;
Phase 3, production of producer gas;
Phase 4, pyrolysis; and
Phase 5, liquefaction.

The order of the phases could be changed or certain phases could be omitted to fit the desired plan. Detailed descriptions of some of the steps and of the apparatus for carrying out the steps in the various phases can be found in my later referenced copending applications which are hereby incorporated by reference.

Figure 1:
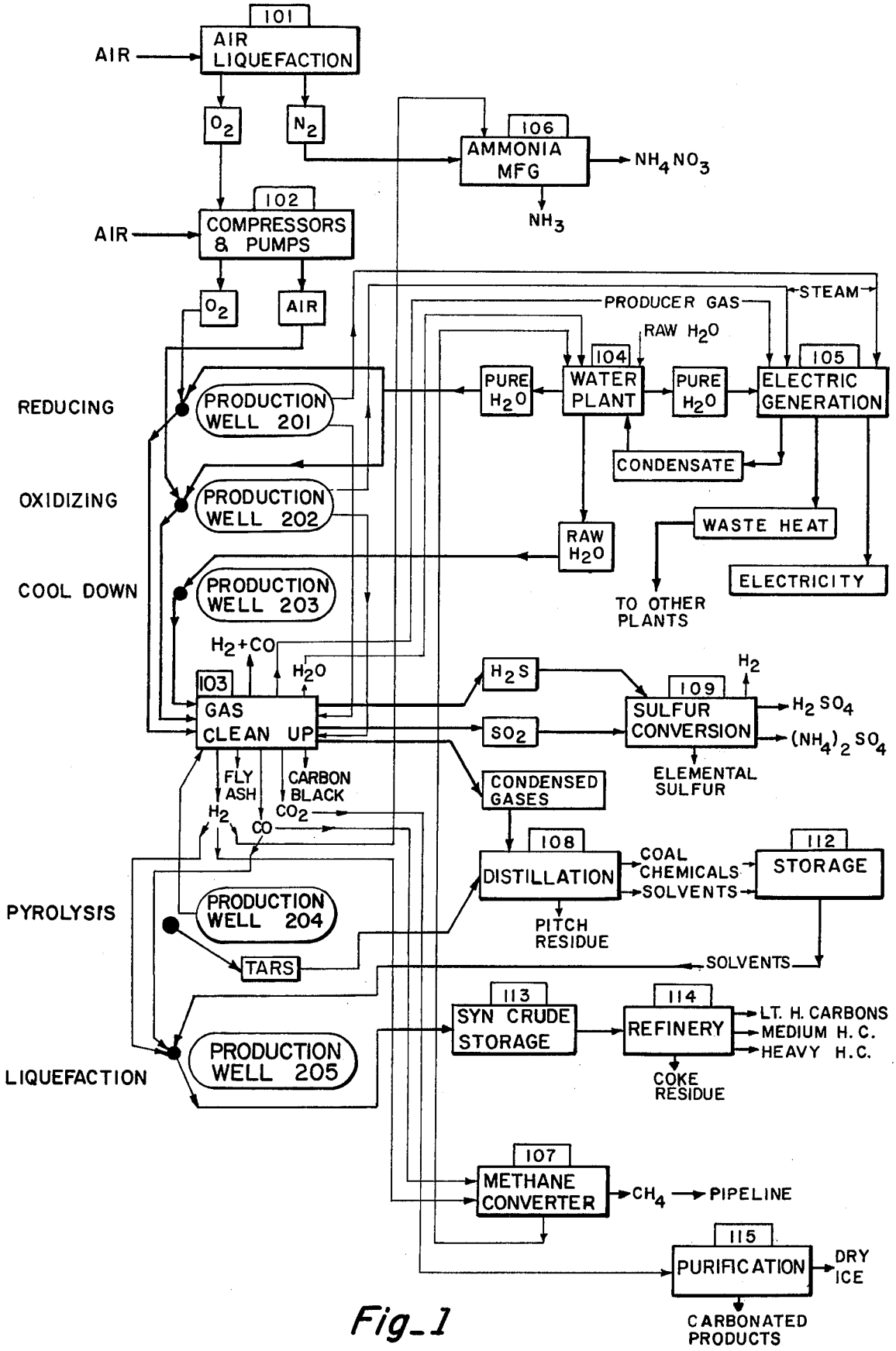
FIG. 1 is a diagrammatic layout showing the various feed streams, the complex of processing and manufacturing plants above ground, and some of the finished products.
Figure 3:
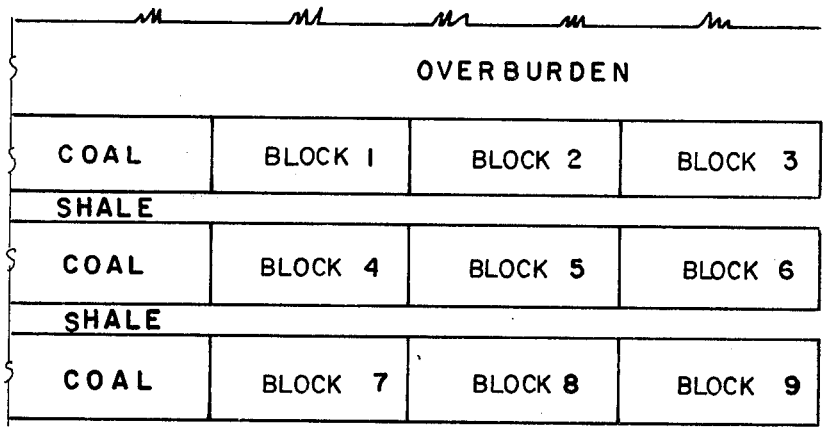
FIG. 3 is a diagrammatic sketch showing the coal and shale sequences underground and is divided into zones that are subjected to the phase processes described herein.
Figure 4:
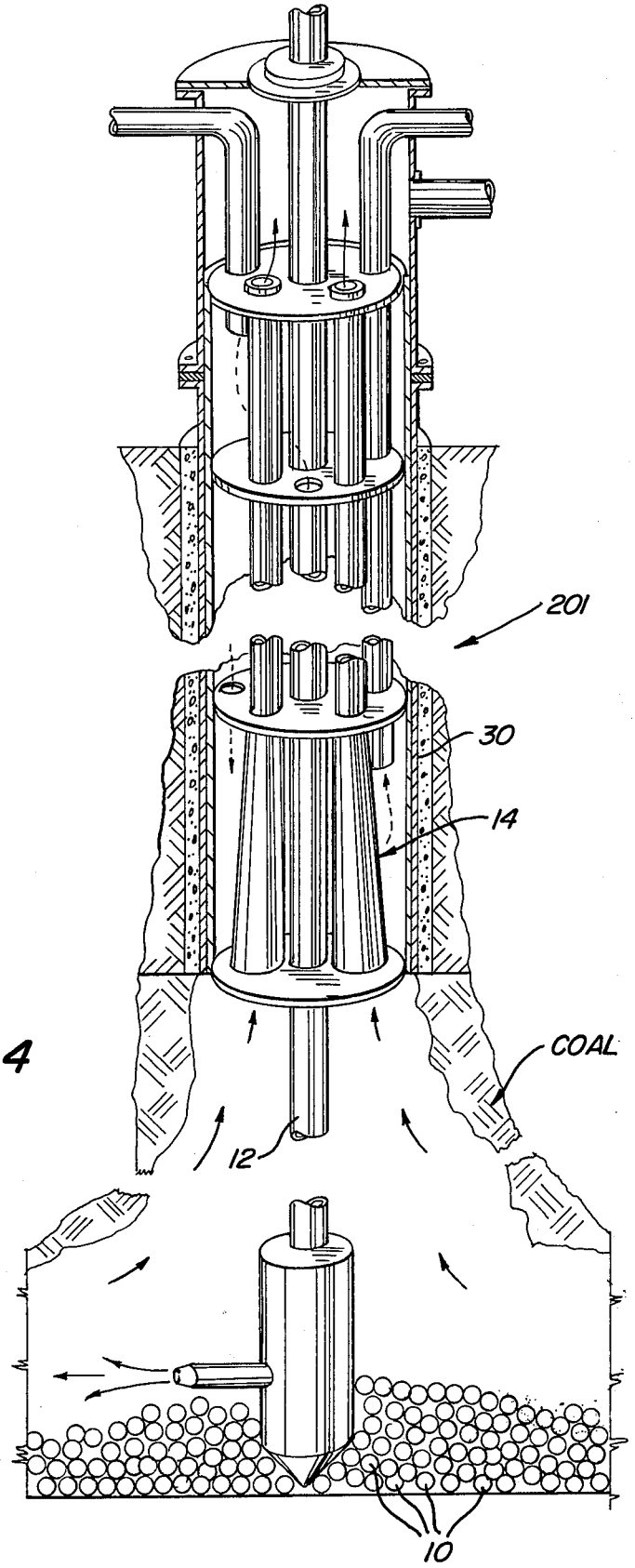
FIG. 4 is a diagrammatic sketch showing a well used for in situ gasification, inlcuding the underground heat exchange apparatus.

Referring first to FIG. 3, coal strata No. 1, 2 and 3 are shown separated by layers of shale. Each coal stratum can be divided into one or more blocks of coal which can be subjected to one or more production phases as described herein. In FIG. 3, these blocks are identified as Blocks 1 through 9. In accordance with a preferred method, in Phase 1, carried out in coal block 7, a well 201, FIG. 1, or a plurality of such wells possibly of the type shown in FIG. 4 are subjected to gasification with the objectives of generating combustible gases, generating heat for conversion into steam, driving off coal tar mists for condensation at the surface, and converting the sulfur to hydrogen sulfide. This method is described in detail in my copending applications Ser. Nos. 510,409 filed Sept. 30, 1974 and 531,453 filed Dec. 11, 1974. The production plan calls for a reducing environment underground in the wells in block 7 and injection of an oxidizer in such a way as to prevent unplanned burning of the exit gases. In order to avoid dilution of the exit gases, the preferred oxidizer is oxygen from a conventional oxygen supply Plant 101, FIG. 1, provided for this purpose. A suitable mine pressure is selected, for example the pressure necessary to balance the hydrostatic head. Wells into coal block 7 are equipped for the purpose intended. Wells to be ignited are pumped free of water, ignition material, such as hot ceramic balls 10, are positioned in the coal strata, and oxygen is injected into the coal formation through an injection conduit 12 as the formation is set of fire. Mine pressure is stabilized by controlling oxidizer injection rates in consonance with gas withdrawal rates. The manner of ignition and stabilizing mine pressure is set forth in the aforementioned application Ser. No. 531,453. Hot exit gases are withdrawn through a heat exchanger 14, FIG. 4, installed in the well bore which is also disclosed in detail in application Ser. No. 531,453. Purified water from a conventional water treating Plant 104, FIG. 1, is circulated through the heat exchanger wherein a portion of the sensible heat in the hot exit gases is transferred to the water converting the water into steam. The steam from the heat exchanger is delivered to a conventional electrical generating Plant 105, FIG. 1, where a portion of its energy is converted into electricity. Steam is condensed in Plant 105 and the condensate is returned to the water Plant 104 to repeat the cycle.

Exit gases from production well 201, FIG. 1, in coal block 7 are delivered to a conventional gas clean-up Plant 103, FIG. 1, where the components of the gas are segregated by conventional means of scrubbing, absorption, adsorption, condensation, and the like. From Plant 103, water vapor is condensed and sent to the water Plant 104, hydrogen is sent to a conventional ammonia Plant 106 and to a conventional methane converter Plant 107. Mists derived from volatile coal tar are condensed and sent to a conventional distillation Plant 108. Hydrogen sulfide is separated and sent to a conventional sulfur conversion Plant 109. Carbon monoxide is sent via a gas pipeline (not shown) to a conventional methane converter Plant 107. Fly ash in the exit gases from production wells, for example well 201, is removed in the gas clean-up Plant 103 and sent to a concrete aggregate plant (not shown). Also, in gas clean-up Plant 103, free carbon particles are separated and recovered as carbon black. A multiplicity of production wells may be drilled into coal zone 7 to increase the volume of hot exit gases produced.

For the preferred method, Phase 2, carried out in coal block 9, a well 202, FIG. 1, or a plurality of such wells which may be similar or identical to the well 201 shown in FIG. 4 are subjected to gasification in accordance with the method and with the apparatus described in my copending applications Ser. Nos. 510,409 and 531,453. The objectives of the wells in block 9 are generating heat for conversion into steam, driving off coal tar mists for condensation at the surface, and converting sulfur to sulfur dioxide. This production plan calls for an oxidizing environment underground and injection of oxidizers in such a way as to burn the coal completely in this zone. The preferred oxidizer is air from a Plant 102 having air compressors therein. A suitable mine pressure is selected, for example the pressure necessary to balance the hydrostatic head. Wells in coal block 9 are of the aforedescribed type as shown in FIG. 4 and are equipped for the purpose intended to include a heat exchanger. Wells to be ignited are pumped free of water. Ignition material, such as the ceramic balls 10, are positioned in the coal strata and air is injected to set the coal on fire. Mine pressure is stabilized by controlling oxidizer injection rates in consonance with gas withdrawal rates. Hot exit gases are withdrawn through the heat exchanger 14 installed in the well bore. Purified water from the water Plant 104 is circulated through the heat exchanger so that a portion of the sensible heat in the hot exit gases is transferred to the water converting the water into steam. Steam is delivered to the electrical generating Plant 105 where a portion of its energy is converted into electricity. Steam is condensed in Plant 105 and the condensate is returned to water Plant 104 to repeat the cycle.

Exit gases from production wells 202 in coal block 9 are delivered to the gas clean-up Plant 103 where the components of the gas are segregated as previously discussed in regard to well 201. From clean-up Plant 103, water vapor is condensed and sent to the water Plant 104 and carbon dioxide is sent to a conventional purification Plant 115, or may be reinjected into a gasification well to react with incandescent coal to form carbon monoxide. Minor amounts of exit gases, such as tar mists, are segregated in the clean-up Plant 103 as described in Phase 1.

For the preferred method, in Phase 3, carried out in coal block 2, the zone is in the latter stages of an in situ gasification process having wells 203, FIG. 1, which may be similar or identical to the well 201 shown in FIG. 4, completed therein. By way of example, half of the coal in place may have been consumed, using the plan of either Phase 1 or Phase 2. Oxidizer injection is terminated and raw water injection from the water Plant 104 is begun through the injection conduit 12 previously used for oxygen injection. As an alternate, if the coal in block 2 is aquifer, mine pressure can be lowered to permit encroachment of surrounding formation water. The incandescent coal in block 2 reacts with injected water for form producer gas ($H_2$ + CO) as described in more detail in my copending application Ser. No. 558,423 filed Mar. 14, 1976. The producer gas can be further processed to adjust the ratio of $H_2$ to CO to form synthesis gas. Producer gas and steam are delivered to the gas clean-up Plant 103 for segregation, for use as described in Phase 5 later, or for other purposes. Phase 3 is a cool down phase that is continued until the remaining coal is cooled down to the desired temperature, for example at least as low as 800° F. Upon reaching the desired temperature, water injection is stopped and the remaining coal in block 2 is ready for liquefaction as described in Phase 5 later. If it is desirable to prolong the cool down, steam may be injected instead of water.

Figure 5:
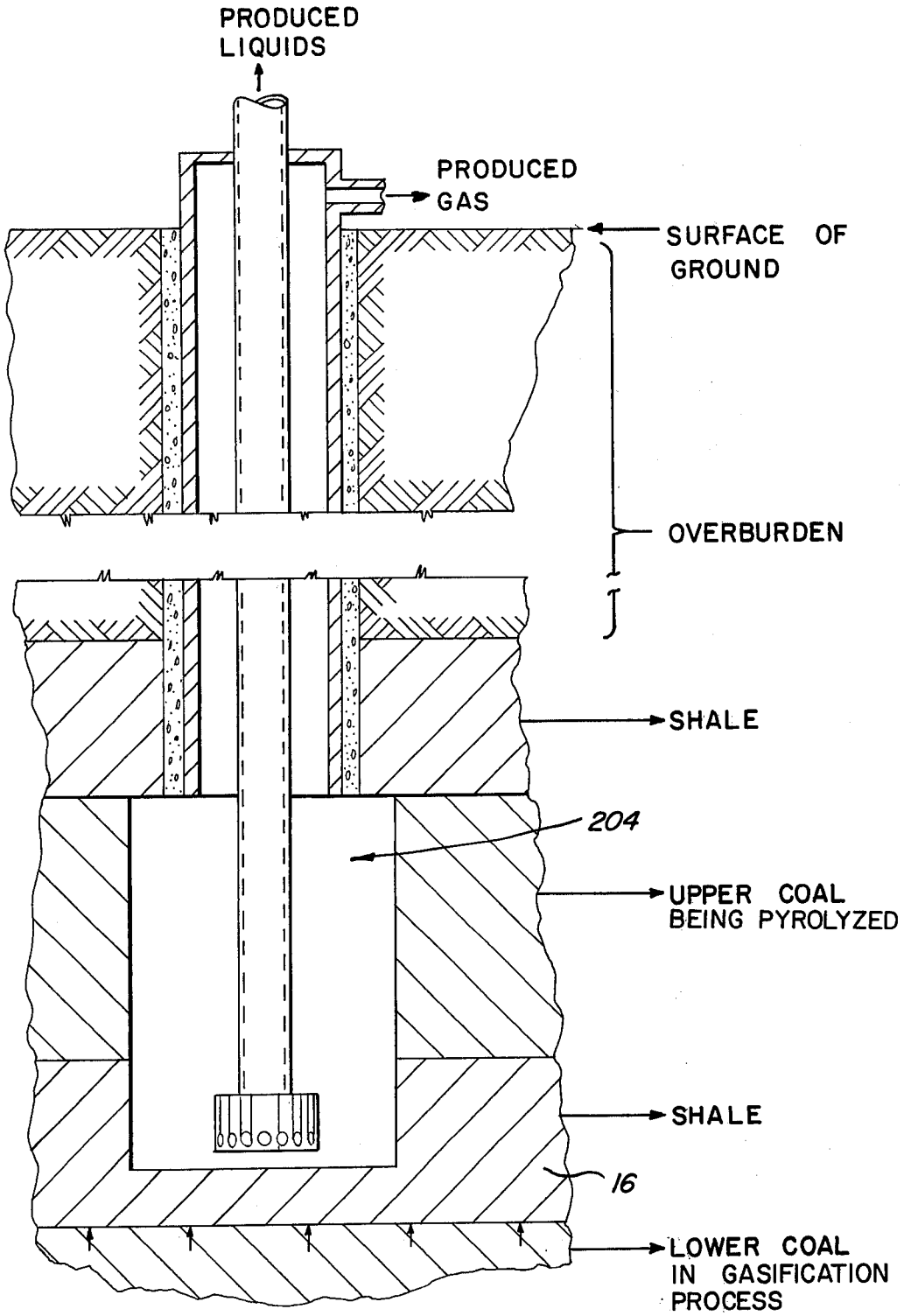
FIG. 5 is a diagrammatic sketch showing a well used for in situ pyrolysis.

In the preferred method, in Phase 4, carried out in coal blocks 4 and 6, the gases are subjected to pyrolysis as described in my copending application Ser. No. 750,714 filed Apr. 23, 1975 with the objectives of driving off volatile matter as gases and oozing tars. This phase is begun after coal blocks 7 and 9 have been under gasification for a period of time, for example, 3 months. The gasification projects in blocks 7 and 9 have generated a substantial amount of heat underground, a portion of which has been transferred through the overlying layer of shale 16 into the coal in blocks 4 and 6. Wells 204, FIG. 1, are drilled into blocks 4 and 6 and are equipped as shown in FIG. 5, so that gases may be withdrawn and delivered to the gas clean-up Plant 103 and so that oozing tars may be collected and delivered to the distillation Plant 108. A complete description of the wells 204 as shown in FIG. 5 can be found in the aforementioned application Ser. No. 570,714. Produced gases are segregated in clean-up Plant 103 for uses as described in Phases 1 and 2 above. Produced tars are distilled into coal chemicals and solvents, with a residue of pitch. Production in Phase 4 continues as long as heat is being added or until substantially all of the volatiles are driven off. Upon completion of Phase 4, the remaining coal may be further produced by gasification as described in Phases 1 and 2 above.

Figure 6:
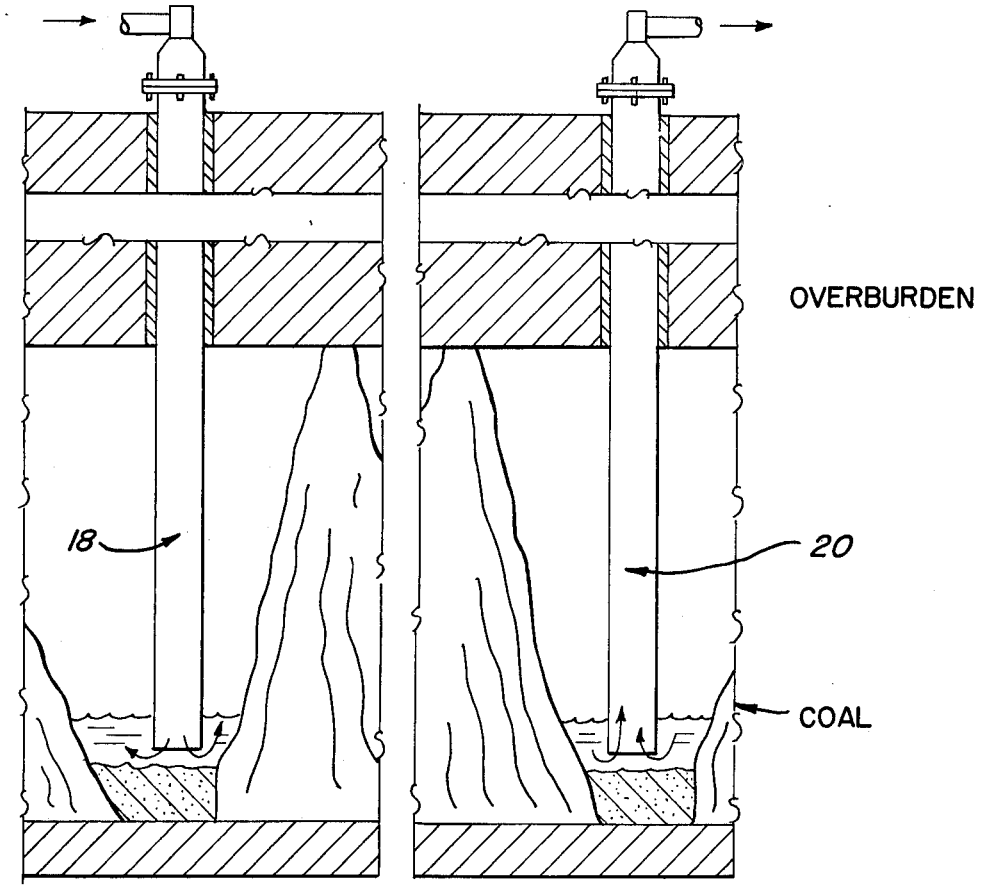
FIG. 6 is a diagrammatic sketch showing wells used for in situ liquefaction.

In the preferred method, in Phase 5, carried out in coal block 2, the zone has been cooled down in accordance with the production plan described in Phase 3 above. Water injection is terminated and solvent injection is begun from a chemical and solvent storage Plant 112. In addition producer gas from the gas clean-up Plant 103 is also injected to percolate through the solvent. Thus the remaining coal in block 2 is subjected to liquefaction by depolymerization and hydrogenation in accordance with the procedures and apparatus disclosed in my copending application Ser. No. 558,423. An example of an injection well 18 and a production well 20 for this purpose are shown in FIG. 6 and described more fully in the aforementioned application Ser. No. 558,423. Injection rates and withdrawal rates are balanced to maintain the desired mine pressure, for example, substantially in equilibrium with hydrostatic head. Excess solvent in the circulating fluids is delivered to the distillation Plant 108 for clean-up recycling. Excess producer gas in the circulating fluids is delivered to the gas clean-up plant 103 for clean-up and recycling. Liquefied coal, which is a synthetic crude oil, is delivered to the storage Plant 113 and to a conventional refinery 114 where it is processed into a variety of hydrocarbons and residual coke. Production continues until the residual coal is substantially consumed.

Referring to FIG. 3 and the production phases described above, block 3 can be subjected to gasification (Phases 1 or 2), followed by cool down and production of producer gas (Phase 3), followed by liquefaction (Phase 5). block 4 can produce first by pyrolysis (Phase 4), followed by gasification (Phases 1 or 2), followed by cool down and production of producer gas (Phase 3), followed by liquefaction (Phase 5). Likewise block 1 can be subjected to the same production sequences as block 4. Other zones in the coal formation such as blocks 5 and 8, can be subjected to one or more production phases described herein.

Referring to FIG. 1, in reviewing the various plants illustrated, those skilled in the art will be able to visualize other processing plants or modification of the functions described for the plants listed without departing from the spirit of the disclosure presented herein. For example, consider electrical generation Plant 105. Should there be a requirement for higher temperature steam than is delivered from Wells 201 and 202, a super heater may be added to Plant 105 to bring the steam up to planned temperature and pressure. The superheater can be fueled from pipeline gas produced on site. Further, steam can be generated in Plant 105 from water or returned condensate by firing a suitable boiler with pipeline gas produced on site, and the like. Also, the electrical generation Plant 105 can be a combined cycle generating plant utilizing gas and steam.

Figure 7:
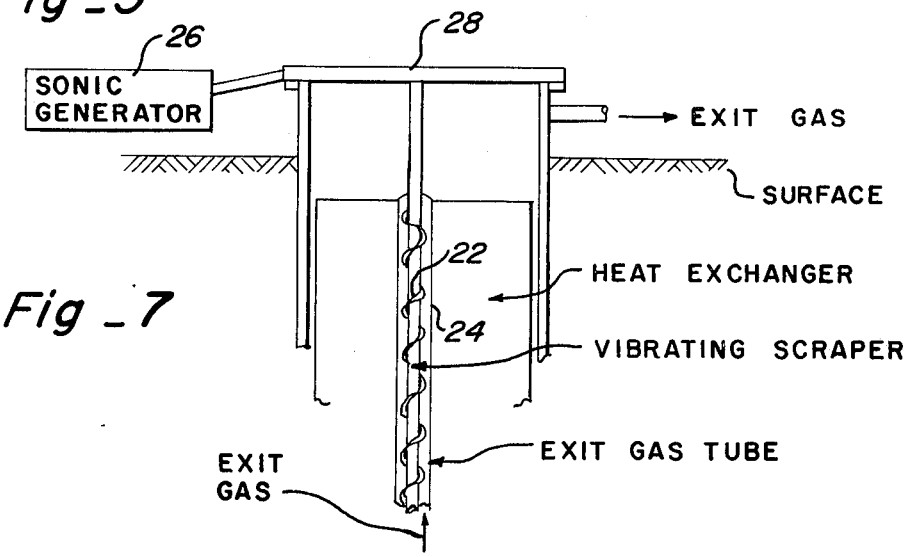
FIG. 7 is a diagrammatic sketch showing a solids removal device in the gas exit tube of a production well.
Figure 2:
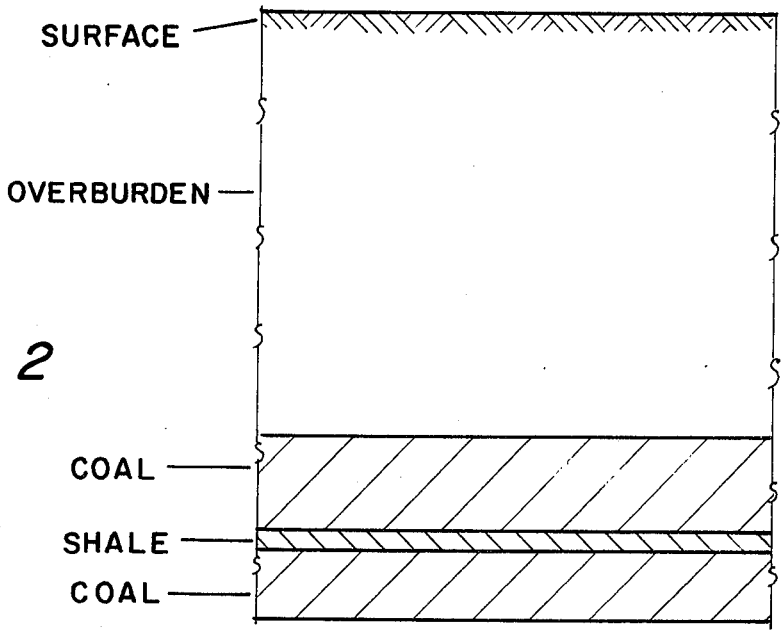
FIG. 2 is a diagrammatic sketch showing the surface of the earth, the overburden, the coal strata and the separating shale strata.

Referring to FIG. 7, hot exit gases from production Wells 201 and 202 (FIG. 1) contain a certain amount of paticulate matter including fly ash from the mineral matter in the coal and free carbon that was not completely consumed in the combustion process. Gases being withdrawn through the heat exchanger, FIG. 4, are being reduced in temperature on the way to the surface. This temperature drop tends to cause some of the particulate matter to stick to the cooler walls of the heat exchanger. To remove this particulate matter and thereby avoid a build up of the matter on the walls which would restrict gas flow, a suitable scraper 22 suspended from the well head extends through the gas exit tubes 24, only one being shown in FIG. 7, in the heat exchanger to the bottom of each tube. A sonic generator 26 is attached to the scraper support plate 28 and sound waves are transmitted to the scrapers. In the preferred embodiment sonic waves are transmitted at the present frequency of the scrapers, causing the scrapers to vibrate. In other embodiments, harmonics of the resonant frequency may be preferred. This vibration causes a scouring action that loosens the particulate matter which is then carried to the surface in the exit gas stream. In severe cases where hot tar mists are condensed and tend to form a sticky plug blocking the exit gas stream, gas flow can be reversed temporarily at the surface by higher pressure oxidizer injection into the exit gas tubes, causing the tars to burn to noncondensible gases, thus purging the exit gas tubes of sticky tars and permitting resumption of normal production.

In the preferred embodiment, the scrapers 22 are in the form of elongated augers, which impart swirling motion to the exit gases and thus provide for a more efficient heat transfer to the circulating water in the heat exchanger.

In addition to the functions of the heat exchanger 14 described in the foregoing processes, the heat exchanger also serves a useful purpose in protecting the well bore. Referring to FIG. 4 it can be appreciated that the protective casing 30 is subjected to a substantial amount of heat from the hot exit gases, particularly in the lower part of the casing. Without the heat exchanger the casing would ultimately be heated cherry red, with resultant expansion and damage to the surrounding concrete seal. The heat exchanger removes heat from the casing area and thus prevents overheating and damage to the concrete seal.

While the above methods, descriptions of apparatus and arrangements of apparatus have been described with a certain degree of particularity, it is to be understood that the present disclosure has been made by way of example and that changes in details of structure may be made without departing from the spirit thereof.

What is claimed is:

1. A method of producing coal in situ wherein the coal is disposed in at least two blocks with a first block overlying a second block and wherein the said first block is separated from the said second block by a layer of a different material comprising the steps of:

gasifying in situ the said second coal block, pyrolyzing the said first coal block with the heat generated by the gasification of the said second block, and recovering the products of gasification and pyrolysis at the surface.

2. The method of claim 1 wherein the said second coal block is being gasified so as to be at an extremely high temperature and further including the steps of terminating injection of oxidizer, then introducing water into the said second block which reacts with the hot coal to form $H_2+CO$.

3. The method of claim 2 further including the step of recovering the $H_2+CO$ at the surface.

4. The method of claim 2 further including the steps of terminating injection of water, then liquefying the said second block by the injection of solvent material into the said second block.

5. The method of claim 4 wherein during the injection of the solvent producer gas also is injected to percolate through the solvent.

6. The method of claim 5 further including the step of recovering the liquefied coal at the surface.

7. The method of claim 6 further including the steps of extracting excess solvents from the said liquefied coal, and extracting excess producer gas from the said liquefied coal.

8. The method of claim 7 further including the step of recovering the liquefied coal at the surface.

* * * * *